US005113740A

United States Patent [19]

Saito

[11] Patent Number: 5,113,740

[45] Date of Patent: May 19, 1992

[54] METHOD AND APPARATUS FOR REPRESENTING MUSICAL TONE INFORMATION

[75] Inventor: Tsutomu Saito, Sizuoka, Japan

[73] Assignee: Kawai Musical Inst. Mfg. Co., Ltd., Sizuoka, Japan

[21] Appl. No.: 470,626

[22] Filed: Jan. 26, 1990

[30] Foreign Application Priority Data

Jan. 26, 1989 [JP] Japan ..... 1-16883

[51] Int. Cl.[5] ..... G10H 7/00

[52] U.S. Cl. ..... 84/607; 84/627

[58] Field of Search ..... 84/607, 622, 623, 624, 84/625, 626, 627, 633; 364/722, 723, 724.17

[56] References Cited

U.S. PATENT DOCUMENTS

| | | | |
|---|---|---|---|
| 4,144,789 | 3/1979 | Deutsch | 84/624 |
| 4,269,101 | 5/1981 | Deutsch et al. | 84/647 |
| 4,672,875 | 6/1987 | Suzuki | 84/627 |
| 4,840,099 | 6/1989 | Kitagawa | 84/627 |
| 4,953,437 | 9/1990 | Starkey | 84/607 |

*Primary Examiner*—William M. Schoop, Jr.
*Assistant Examiner*—Helen Kim

[57] ABSTRACT

A method of performing an operational expression representing an operation on first and second operands used for computing various problem data and information relating to musical tones, the method comprising the step of representing problem data, which are to be processed, by using a representation system by which the first and second operands have the same sign, and by which the value of one of the first and second operands represented by bits having orders higher than those of bits used for representing the other of the operands is reduced by effecting a suppressing operation by using a suppressing parameter having a value larger than the value that can be obtained by the one of the first and second operands represented by the higher-order bits and the value of which is to be reduced, the step of computing mantissa part data of the thus represented problem data in accordance with power part data of the thus represented problem data, and the step of performing an carry operation if a carry is generated in the mantissa data.

38 Claims, 8 Drawing Sheets

0dB
-96dB
0dB
SIGN BIT="0"
SIGN BIT="1"
FI
WAVEFORM DATA W

0dB
-96dB
INTERPOLATION DATA R(R̄) FF

0dB
-96dB
ENVELOPE DATA EN
TIME

FIG. 4

| LEVEL dB | POWER PART DATA P | P-16 QUANTITY OF DOWN SHIFT | MUSICAL TONE DATA LEVEL |
|---|---|---|---|
| 0 | | | $2^{0}$ |
| -6 | 1111 (15) | -1 | $2^{-1}$ |
| -12 | 1110 (14) | -2 | $2^{-2}$ |
| -18 | 1101 (13) | -3 | $2^{-3}$ |
| -24 | 1100 (12) | -4 | $2^{-4}$ |
| -30 | 1011 (11) | -5 | $2^{-5}$ |
| -36 | 1010 (10) | -6 | $2^{-6}$ |
| -42 | 1001 ( 9) | -7 | $2^{-7}$ |
| -48 | 1000 ( 8) | -8 | $2^{-8}$ |
| -54 | 0111 ( 7) | -9 | $2^{-9}$ |
| -60 | 0110 ( 6) | -10 | $2^{-10}$ |
| -66 | 0101 ( 5) | -11 | $2^{-11}$ |
| -72 | 0100 ( 4) | -12 | $2^{-12}$ |
| -78 | 0011 ( 3) | -13 | $2^{-13}$ |
| -84 | 0010 ( 2) | -14 | $2^{-14}$ |
| -90 | 0001 ( 1) | -15 | $2^{-15}$ |
| -96 | 0000 ( 0) | -16 | $2^{-16} \fallingdotseq 0$ |

FIG. 5A

VALID

```
   1111 (15)
   1111 (15)
+) ---------
  11110 (30)
      ↓
   1110 (14)
      ↓
```

DOWNWARD SHIFT BY 2 BITS

FIG. 5B

VALID

```
   1001 (9)
   0111 (7)
+) ---------
  10000 (16)
      ↓
   0000 (0)
      ↓
```

DOWNWARD SHIFT BY 16 BITS

FIG. 5C

INVALID

```
   1001 (9)
   0101 (5)
+) ---------
  01110 (14)
      ↓
  11110 (-2)
      ↓
```

DOWNWARD SHIFT BY 18 BITS
(IMPOSSIBLE)

METHOD AND APPARATUS FOR REPRESENTING MUSICAL TONE INFORMATION

BACKGROUND OF THE INVENTION

1. Field of The Invention

This invention relates to a system for representing musical tone information used in an electronic musical instrument, and more particularly, to an improvement in the processing of quantities or operands used in an operational expression representing the musical tone information.

2. Description of the Related Art

In conventional electronic musical instruments, musical tone information, for example, information on amplitude levels of a signal representing a musical tone, is obtained by first determining or selecting the waveform of the musical tone and then multiplying the magnitude of the voltage of a signal indicating the musical tone having the determined or selected waveform at each moment by a corresponding level of an envelope, or adding a level of an envelope to the magnitude at the voltage of a signal indicating the musical tone having the determined or selected waveforms at each moment. Further, the magnitude of the voltage of the musical tone is represented by a large number of discrete levels in the electronic musical instrument. Therefore, to represent a smaller change in magnitude in voltage of the signal by increasing the number of discrete levels (i.e., by making the interval between two contiguous levels smaller), it is necessary to increase the number of bits used for representing the data (hereunder referred to as waveform data and envelope data) representing the waveform and the envelope, and therefore, the number of bits required for representing the result of the multiplication of the waveform data and the envelope data is also increased. Accordingly, a multiplying circuit or multiplier able to process data represented by a large number of bits becomes necessary.

Noted, the value [EN] of the envelope data EN and the value [W] of the waveform data W can be represented in the following forms.

$$[EN] = 2^{Pa} \times 2^{Ma} \quad (1)$$
$$(Pa = \ldots, -2, -1, 0, 1, 2, \ldots 0 \leqq Ma < 1)$$

$$[W] = 2^{Pw} \times 2^{Mw} \quad (2)$$
$$(Pw = \ldots, -2, -1, 0, 1, 2, \ldots 0 \leqq Mw < 1)$$

Therefore, the result [RM] of the multiplication of the envelope data EN and the waveform data W is expressed as follows.

$$[RM] = (2^{Pa} \times 2^{Ma}) \times (2^{Pw} \times 2^{Mw}) = 2^{(Pa+Pw)} \times 2^{(Ma+Mw)} \quad (3)$$

As understood from equation (3), the result [RM] can be computed by first effecting the addition of the exponents. Note, the multiplicand ($2^{(Pa+Pw)}$) and the multiplicator or multiplier ($2^{(Ma+Mw)}$) will be sometimes referred to hereafter as a power data and a mantissa data respectively. Further, the multiplicators $2^{Ma}$, $2^{Mw}$ and $2^{(Ma+Mw)}$ in the expressions (1) and (2) are similar to or correspond to a mantissa when using a well-known floating-point representation of data, and therefore, the exponent (for example, Ma, Mw or (Ma+Mw)) of a multiplicator will be sometimes referred to hereafter as the mantissa part data. Moreover, the exponents Pa, Pw and (Pa+Pw) of the multiplicand $2^{Pa}$, $2^{Pw}$, or $2^{(Pa+Pw)}$ in the expressions (1) and (2) are similar to or correspond to, a power in case of using well-known floating-point representation of data, and thus the exponent (for example, Pa, Pw or (Pa+Pw)) of a multiplicand will be sometimes referred to hereafter as the power part data.

Where the musical tone information or data is represented by using the above-described expression, it is preferable to obtain a dynamic range in which the maximum absolute value of a decibel is around 90 dB–96 dB.

Further, when using a first conventional type expression given basically by the following equation:

$$2^P \times 2^M$$
$$(P = Pa + Pw = -16, -15, -14, \ldots, -2, -1.$$
$$0 \leqq M(= Ma + Mw) < 1)$$

the relation ship between the power part data P and the decibel is listed below. Note, the notation "X" will be used hereafter to indicate that X is a binary number.

| | | |
|---|---|---|
| P = "10000" | (= −16) | −−96 dB |
| "10001" | (= −15) | −−90 dB |
| "10010" | (= −14) | −−84 dB |
| . | . | . |
| . | . | . |
| . | . | . |
| "11110" | (= −2) | −−12 dB |
| "11111" | (= −1) | −−6 dB |

In this case, as many as 5 bits are required for representing the power part data P corresponding to around −90 dB.

Next, when using a second conventional type expression given basically by the following equation:

$$2^{-P} \times 2^M$$
$$(P = Pa + Pw = 0, 1, 2, 3, \ldots, 15.$$
$$0 \leqq M(= Ma + Mw) < 1)$$

the relation ship among the power part data P, the quantity P' (= −P), and the decibel is as listed below.

| | | |
|---|---|---|
| P = "0000" | (P' = −0) | − 0 dB |
| "0001" | (−1) | − −6 dB |
| "0010" | (−2) | −−12 dB |
| . | . | . |
| . | . | . |
| . | . | . |
| "1110" | (−14) | −−84 dB |
| "1111" | (−15) | −−90 dB |

Therefore, in this case, although only 4 bits are required for representing the power part data P, around −90 dB can be achieved, but this second conventional type expression has encountered the problem as described hereafter.

Namely, when performing the following operation $$[RM] = (2^{-Pa} \times 2^{Ma}) \times (2^{-Pw} \times 2^{Mw}) = 2^{-(Pa \times Pw)} \times 2^{(Ma \times Mw)} \quad (4)$$

if the exponent (Ma×Mw) is equal to or larger than 1, a carry operation must be performed as expressed in the following equations.

$$M = Ma + Mb - 1$$
$$P = -(Pa + Pw) + 1$$
$$= -(Pa + Pw \underline{-1})$$

Namely, the power part data P is not incremented by 1 but decremented by 1, due to the carry generated in the mantissa part data M, and accordingly, when using the second conventional type expression, the calculation of the mantissa part data M must be made separately from that of the power part data P.

The present invention is intended to solve the problem of the conventional system.

Therefore an object of the present invention is to provide an improved system in which the carry operation can be easily and simply performed when a carry is generated in the mantissa M.

SUMMARY OF THE INVENTION

To achieve the foregoing object, and in accordance with the present invention, there is provided an improved method of performing an operational expression representing an operation on a power and mantissa data used for computing various problem data and information related to a musical tone, the method comprising the step of representing problem data, which are to be processed, by using a representation system by which the power and mantissa data have the same sign, and by which the value of one of the power and mantissa data represented by bits having orders higher than those of bits used for representing the other of the data is reduced by effecting a suppressing operation using a suppressing parameter having a value larger than the value that can be obtained by the one of the power and mantissa data represented by the higher-order bits and the value of which is to be reduced, the step of computing mantissa part data of the thus-represented problem data in accordance with power part data of the thus-represented problem data, and the step of performing an carrying operation if a carry is generated in the mantissa data.

Therefore, even if a carry is generated in the mantissa part data M, the carry operation can be easily and simply performed in the same manner as in the case of a usual overflow processing.

Further, a third type operational expression, which can be used in the system according to the present invention, is given by the following equation:

$$2^{P-16} = 2^{M}$$
$$(P = 0, 1, 2, 3, \ldots, 15.\ 0 \leqq M < 1)$$

the relation ship among the power part data P, the quantity P'' (=P−1), and the decibel is also listed below,

| | | |
|---|---|---|
| P = "0000" | (P' = −16) | −−96 dB |
| "0001" | (−15) | −−90 dB |
| "0010" | (−14) | −−84 dB |
| . | . | . |
| . | . | . |
| . | . | . |
| "1110" | (−2) | −−12 dB |
| "1111" | (−1) | − −6 dB |

Therefore, in this case, the dynamic range in which the maximum absolute value of the decibel is around 96 dB can be realized by using only 4 bits for representing the power P.

The result [RM] of the multiplication of the envelope data and the waveform data is given by the following equation:

$$[RM] = (2^{(Pa-16)} \times 2^{Ma}) \times (2^{(Pw-16)} \times 2^{Mw}) \quad (5)$$
$$= 2^{(Pa+Pw-16-16)} \times 2^{(Ma+Mw)}$$

When the exponent (Ma+Mw) is equal to or larger than 1, a carry operation can be simply performed, as can be understood from the following equations.

$$M = Ma + Mw - 1$$
$$P = (Pa + Pw - 16 - 16) + 1$$
$$= (Pa + Pw - 16 \underline{+1}) - 16$$

Namely, as can be easily understood from the underlined part of the above equation, the power part data P is simply incremented by 1 due to the carry generated in the mantissa part data M. This means that, when using the third type operational expression, the power part data P and the mantissa part data M can be put together and easily processed at the same time.

Note, the number (−16) in the parentheses of the equation $\{P=(Pa+PW-16+1)-16\}$ corresponds to an overflow bit when performing the addition (Pa+Pw).

Therefore, if the exponent P of the power data (i.e., the multiplicand) $2^P$ of the first type conventional expression is less than or equal to 16, the power data $2^P$ must be replaced with, for example, an operand or term $2^{P-16}$. Accordingly, the sign of the exponent P and that of the exponent M of the mantissa data (i.e., the multiplicator or multiplier) become the same, and therefore, when a carry is generated in the mantissa part data M, the carry operation can be easily performed by simply incrementing the power part data P by 1.

Note, the number 16 in the exponent (P-16) of the multiplicand may be another number larger than 16, and in a preferred embodiment described later, a term (M/1024) is used in place of the term M as the exponent of the multiplicator.

BRIEF DESCRIPTION OF THE DRAWING

Other features, objects, and advantages of the present invention will become apparent from the following description of a preferred embodiment with reference to the drawings, in which like reference characters designate like or corresponding parts throughout several views, and in which:

FIG. 4 is a diagram illustrating the relationship between the power part data and the quantity of a downward shift, as described later;

FIGS. 5A-5C are diagrams illustrating examples of valid or invalid addition of the power part data;

DESCRIPTION OF THE PREFERRED EMBODIMENT

Figure 1:
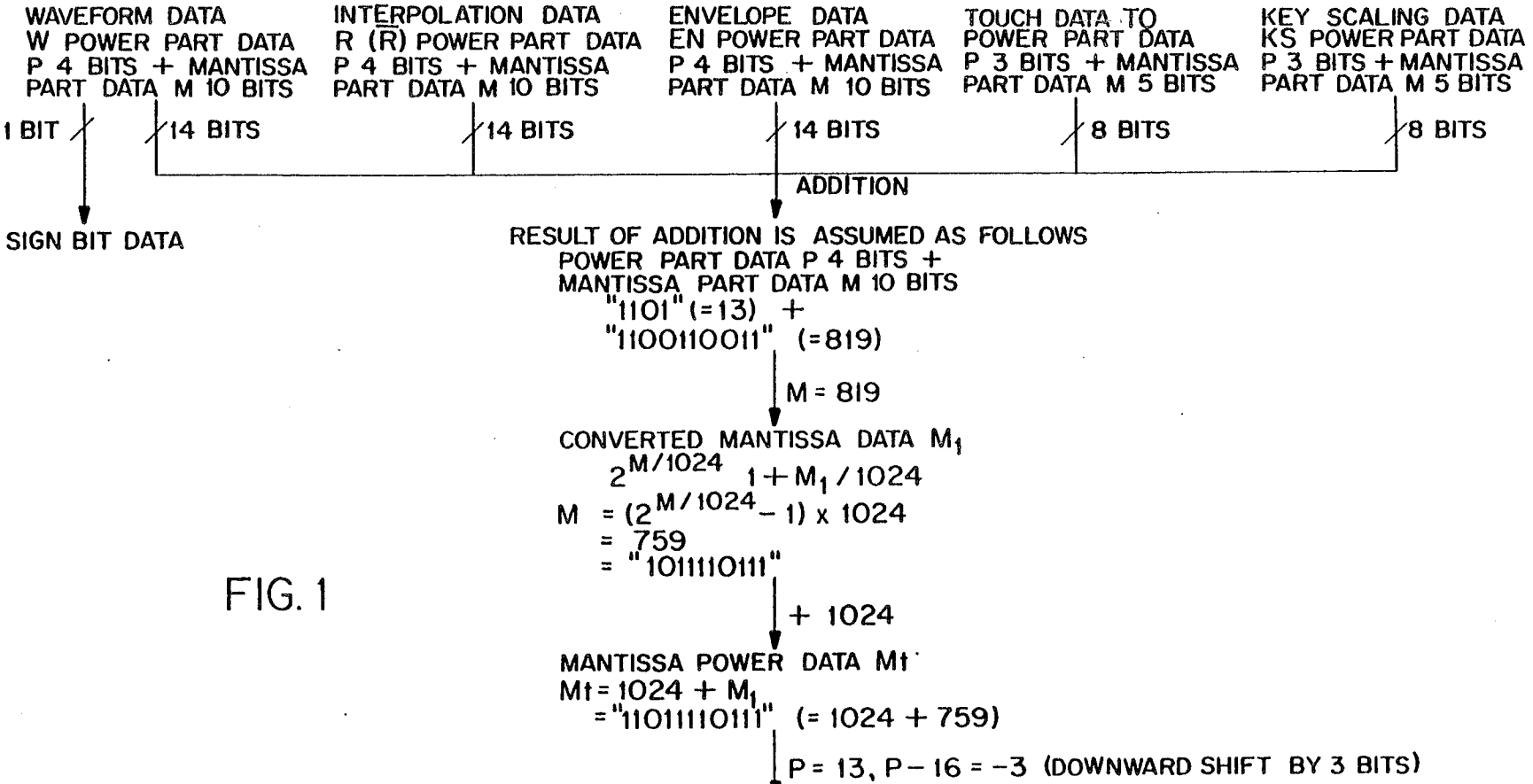
FIG. 1 is a diagram illustrating the process of processing data on musical tones according to the present invention.

Hereinafter, a preferred embodiment of the present invention will be described with reference to the accompanying drawings.

FIG. 2 is a general circuit diagram of the preferred embodiment of the present invention, and each operating key of a keyboard 1, as well as each operating switch of a tone selecting switchboard 2, of this figure is scanned by a central processing unit (CPU) 3. A musical tone having a tone pitch corresponding to the operated key of the keyboard 1 and a timbre corresponding to the operated switch of the tone selecting switchboard 2 is assigned to an idle channel of a musical tone generating system provided with a plurality of channels, and further, the assignment storing circuit 4 stores information on how the timbres are assigned to the channels.

Furthermore, the keyboard 1 sends data indicating the operated key to the CPU 3, whereupon the data is first converted by a processing program into a corresponding key code, the key code is further converted by the program into data representing the number FN of a frequency (hereafter sometimes referred to as the frequency number FN) of the musical tone corresponding to the operated key, and the data representing the frequency number FN is stored in the assignment storing circuit 4. This conversion processing may be effected by a decoder. Further, the data sent from the keyboard 1 and indicating the operated key may be directly converted to the data representing the frequency number FN.

Also, in accordance with data indicating the operated switch of the tone selecting switchboard 2, corresponding timbre coefficient data stored in a read-only memory (ROM) 6 is read by the CPU 3 and then stored in the assignment storing circuit 4. This timbre coefficient data is used for selecting one of the waveforms of musical tones stored in a memory (hereafter referred to as a waveform data storing memory) 8, as described later, for storing data representing a plurality of kinds of waveforms of the musical tones, and further, is used for selecting one of the envelope waveforms generated by an envelope generator 9.

A plurality of switches are attached or connected to each of the operating keys of the keyboard 1; each of these switches being turned on when a predetermined time has elapsed (i.e., a predetermined time lag) since the key was pressed. Further, velocity data corresponding to these time lags are generated in a touch sense circuit 5 and are converted by the program in the CPU 3 into touch data TO. As seen from FIG. 3 (4), the greater the value of the touch data TO, the higher becomes the volume of the corresponding musical tone. Namely, as the value of the touch data becomes larger, the corresponding musical tone is emphasized with regard to the volume thereof (i.e., the volume of the corresponding musical tone is increased). This touch data TO is stored in a storage area (hereafter sometimes referred to as a channel area) in the assignment storing circuit 4 corresponding to the channel to which the musical tone having the timbre corresponding to the operated or pressed key is assigned. This processing of converting velocity data to touch data may be performed by using a conversion table. Further, instead of data representing the velocity of pressing down a key of the keyboard 1, data representing the pressure of pressing down a key thereof, which is detected by a pressure sensor attached to or provided at each key thereof, may be used as the touch data TO.

Figure 3:
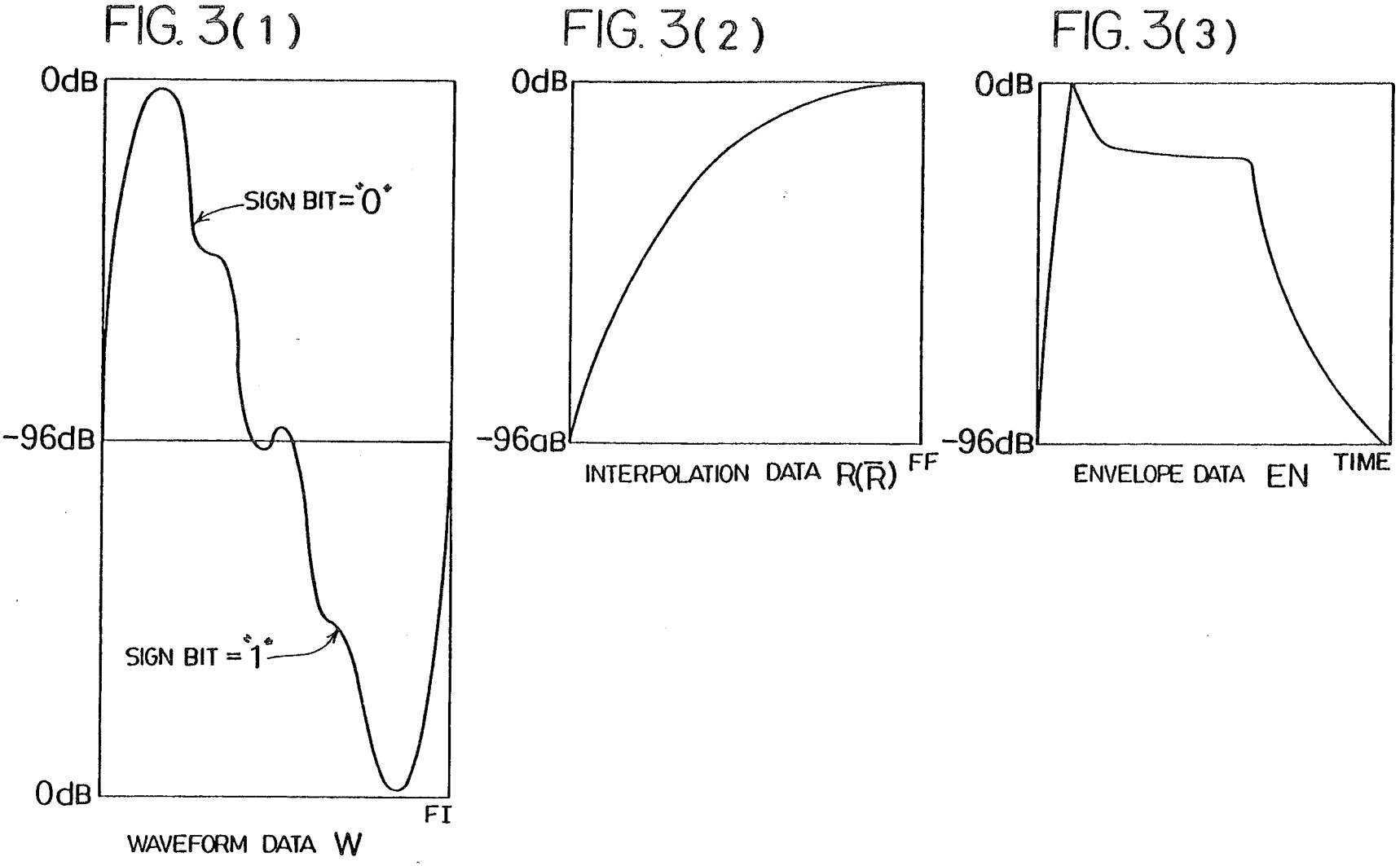
FIG. 3 (1), (2), (3), (4) and (5) are graphs showing the powers of various data used in the system of the present invention.

Furthermore, the data indicating the operated key of the keyboard 1 or the key code is converted by the program in the CPU3 into key scaling data KS, as shown in FIG. 3 (5), and used for emphasizing a musical tone of the middle register (i e., a middle division of the compass) of an electronic musical instrument with regard to the volume thereof. This scaling data KS is stored in another channel area in the assignment storing circuit 4.

Note, the ROM 6 is used to store the processing program to be executed by the CPU 3, and various data such as the timbre coefficient data. On the other hand, a random access memory (RAM) 7 is used as an intermediate memory, i.e., is used to store data representing an intermediate result of the various processes.

The data thus preset in the channel areas in the assignment storing circuit 4 is read therefrom at the time or moment (hereafter sometimes referred to as the channel time) arranged at every channel. Among this data, the frequency number data FN is set in an address controller 10 and further accumulated at each channel time. Further, data FI indicating an integer part (hereafter sometimes referred to as integer part data) represented by high-order bits, which is used for representing the accumulated frequency number data, is supplied to a memory (hereafter referred to as a waveform data memory) 8 for storing data W representing the waveform of a musical tone (hereafter referred to as waveform data) through an adder AD1. Thereafter, the waveform data W is repeatedly read out of the waveform data memory 8, whenever necessary, during the steps of the various processes. Note, in each timbre coefficient data stored in the assignment storing circuit 4, a part used for selecting the waveform of a musical tone is represented by bits having orders which are higher than the bits used for representing the integer part data FI of the accumulated frequency number data.

Data "00 . . . 00" is input to an input terminal of the adder AD1 other than an input terminal to which the data FI is input. Further, a clock signal $\phi$ is input to a $C_{in}$ terminal of the adder AD1. The integer part data FI of the accumulated frequency number data from the address controller may be incremented by 1 when inputting the clock signal $\phi$ having a period or cycle which is almost the same as a processing time (hereafter referred to as a channel processing time) required for effecting a processing of the data process to be performed for a channel. Therefore, in a channel processing time, waveform data $W_n$ required for performing the processing of the current reading step, and waveform data Wn+1 required for performing the processing of the next reading step, are read out to effect an interpolation of the required waveform data W, in two successive steps, as described hereafter.

Further, data FF (hereafter referred to as fraction data) representing a fraction or decimal part of the accumulated frequency number data is supplied to an interpolation data decoder 12 through exclusive-OR gates (EXOR gates) 11, and thereafter, interpolation data R obtained in the interpolation data decoder 12 is read therefrom. As shown in FIG. 3 (2), the interpolation data R is equal to "11 . . . 11" corresponding to 0 dB where he fraction data FF is equal to "00 . . . 00", and the data R is equal to "00 . . . 00" corresponding to −96 dB (thus substantially corresponding to $-\infty$ dB) where the fraction data FF is equal to "11 . . . 11". Therefore, as the value of the fraction data FF becomes larger (namely, as time elapses from the time of reading the waveform data $W_n$ required in the current step, and the current moment approaches the time of starting the next step), a weight of the data Wn used in the interpolation is changed from 1 and brought closer and closer to 0.

The clock signal $\phi$ is also supplied to each of the EXOR gates 11, and then the fraction data FF, or data obtained by subtracting the fraction data FF from 1, is supplied to the interpolation data decoder 12. In a second half of the period of the clock signal $\phi$, wherein the waveform data $W_{n+1}$ required for effecting the next step is read out of the waveform data memory 8, as the value of the fraction data FF increases, the weight of the data $W_n$ changes from 0 and approaches 1, converse to the case of a first half of the period of the clock signal $\phi$. Therefore, as the value of the fraction data F increases, the weight or quantitative superiority of the waveform data $W_n$ in the interpolation data R decreases, and in contrast, that of the waveform data $W_{n+1}$ increases (i.e., the quantitative superiority in the interpolation data is passed smoothly by the currently used waveform data $W_n$ to the next waveform data $W_{n+1}$). Further, the result RI of the interpolation of the waveform data is obtained by the following equation:

$$[RI]=[W_n]\times[R]+[W_{n+1}]\times[R] \quad (7)$$

where R denotes the interpolation data read from the interpolation data decoder 12 by addressing in the direction of from the starting address to the ending address thereof in accordance with the fraction data FF supplied thereto; $\overline{R}$ denotes another interpolation data read out from the interpolation data decoder 12 by addressing in the direction of from the ending address to the starting address thereof in accordance with the data obtained by subtracting the fraction data FF from 1 and supplied thereto; [RI] denotes the value of the result RI of the interpolation; $[W_n]$ denotes the value of the waveform data $W_n$; [R] denotes the value of the interpolation data R; $[W_{n+1}]$ denotes the value of the waveform data $W_{n+1}$; and [R] denotes the value of the interpolation data $\overline{R}$. Further, the addition in the equation (7) is performed by an accumulator 13, as described later, during the accumulation of data of the musical tones of all of the channels. This interpolation processing may be performed by executing the program in the CPU 3.

Among the data read out of the assignment storing circuit 4 at each channel time, the timbre coefficient data on the envelope is sent to the envelope generator 9, which generates and outputs data indicating the level in voltage of the envelope waveform in each of the steps. The envelope generator 9 also sends phase data to the assignment storing circuit 4, which causes the circuit 4 to output the timbre coefficient data relating to the envelop to be used in the next phase of the processing. Further, the envelope generator 9 is adapted to output envelope data EN for the plurality of the channels under the control of a time sharing system. In this embodiment, each of the waveform data W, the interpolation data R and $\overline{R}$, and the envelope data EN is composed of data (i.e., power part data) P indicating the value of a power and represented by using 4 higher-order bits and data (i.e., mantissa part data) M representing the value of the exponent of a mantissa (represented in the form of 2 to the Mth power), and represented by using lower-order 10 bits.

Furthermore, among the data read out of the assignment storing circuit 4 at each channel time, the touch data TO and the key scaling data KS are preset in a touch data register 14 and a key scaling register 15, respectively. The number of each of these registers TO and KS, which are adapted to respectively output the touch data TO and the key scaling data KS corresponding to the musical tone assigned to each channel, is equal to the number of channels.

Moreover, each of the touch data TO and the key scaling data KS consists of a higher-order 3-bit power part data P and a lower-order 5-bit mentissa part data M, since this data TO and KS is processed by the 8-bit CPU 3. Where an arithmetic operation on a 4-bit power part data and a 3-bit power part data is carried out, bit data indicating "1" is added to the 3-bit power part data as an additional bit having an order higher than the highest-order bit of the 3-bit power part data. Further, where an arithmetic operation is performed on a 10-bit mantissa part data and a 5-bit mantissa part data, 5-bit data indicating "11111" or "00000" is added to the 5-bit mantissa part data as an additional bit having an order lower than the lowest-order bit of the 5-bit mantissa part data. All of this data W, R, $\overline{R}$, EN, TO and KS is added by adders AD2, AD3, AD4, and AD5, as described later, as shown in FIG. 2B, and further, the result of the addition of the data W, R, $\overline{R}$, EN, TO and KS is converted by a converter (hereafter referred to as a mantissa converter) 16, using a mantissa conversion table and a barrel shifter 17, into a linear value ($2^{P-1}+2^{M/1024}$), and thereafter, is output in the form of the corresponding musical tone or sound. The foregoing operational expression ($2^{P-1}+2^{M/1024}$) means that a power data (i.e., a multiplicand) ($2^{P-1}$) is multiplied by a mantissa data (i.e., a multiplier). Further, a downward or right shift of the result of this multiplication is performed (i.e., the result of this multiplication is shifted to the right) by the barrel shifter 17 and accordingly, the value of the result of this multiplication is reduced.

As can be understood from the relationship between the waveform data W and the envelope data EN, etc., all of the data W. R, (or $\overline{R}$), EN, TO and KS is multiplied together. In general, however, a multiplication operation can be expressed as, for example, ($2^a\times2^b$) (a and b are exponents) by expressing each of the power and mantissa data in the form of a power of two. Further, the multiplication ($2^a\times2^b$) is performed by first effecting the addition (a+b) of the exponents a and b and then computing the value of the (a+b)'th power of two. After this addition, the result thereof is converted into a linear value by the mantissa converter 16 and the barrel shifter 17.

FIG. 1 is a diagram illustrating how the above described process is performed, assuming the power part data P is 13. First, the data W, R (or $\overline{R}$), EN, TO and KS are added to each other. Note, at that time, even is a carry is generated in the mantissa part data M, the carry can be easily and simply performed in the same way as in the case of a usual overflow processing, because the sign of the mantissa part data M is the same as that of the power part data P, as can be understood from the expression ($2^{P-1}+2^{M/1024}$).

When the power part data P and the mantissa part data M are equal to "11 . . . 11" (i.e., the data P is equal to 15, and the data M is equal to 1023), the waveform data W, interpolation data R (or $\overline{R}$), envelope data EN, touch data TO, and key scaling data KS are equal to 1 because $2^{P-1}+2^{M/1024}=2^{15-16}\times 2^{1023/1024}=2^0=1$. Further, when the power part data P and the mantissa part data M are equal to "00 . . . 00" i.e., the data P and M are equal to 0), the waveform data W, interpolation data R (or $\overline{R}$), envelope data EN, touch data TO, and key scaling data KS are almost the same as 0 because $2^{P-1}+2^{M/1024}=2^{0-16}\times 2^{0/1024}=2^{-16}\div 0$. In FIG. 3, the axes of the ordinates represent the ratio of a value of the data W, R, $\overline{R}$, EN, TO or KS to a reference value thereof in terms of a decibel (abbreviated dB), which ranges from 0 (corresponding to the case wherein the value of the data is equal to $2^0$) to −96 dB (÷ − ∞ dB) (corresponding to the case wherein the value of the data is equal to $2^{-16}$). In addition, correspondingly to this range of the ratio of the data from 0 to −96 dB, the power part data P varies between 0 and 15, and the mantissa part data M ranges between 0 and 1023. Namely, the power P is 0 or positive, while the exponent (P−16) of the power data is negative.

Figure 2A:
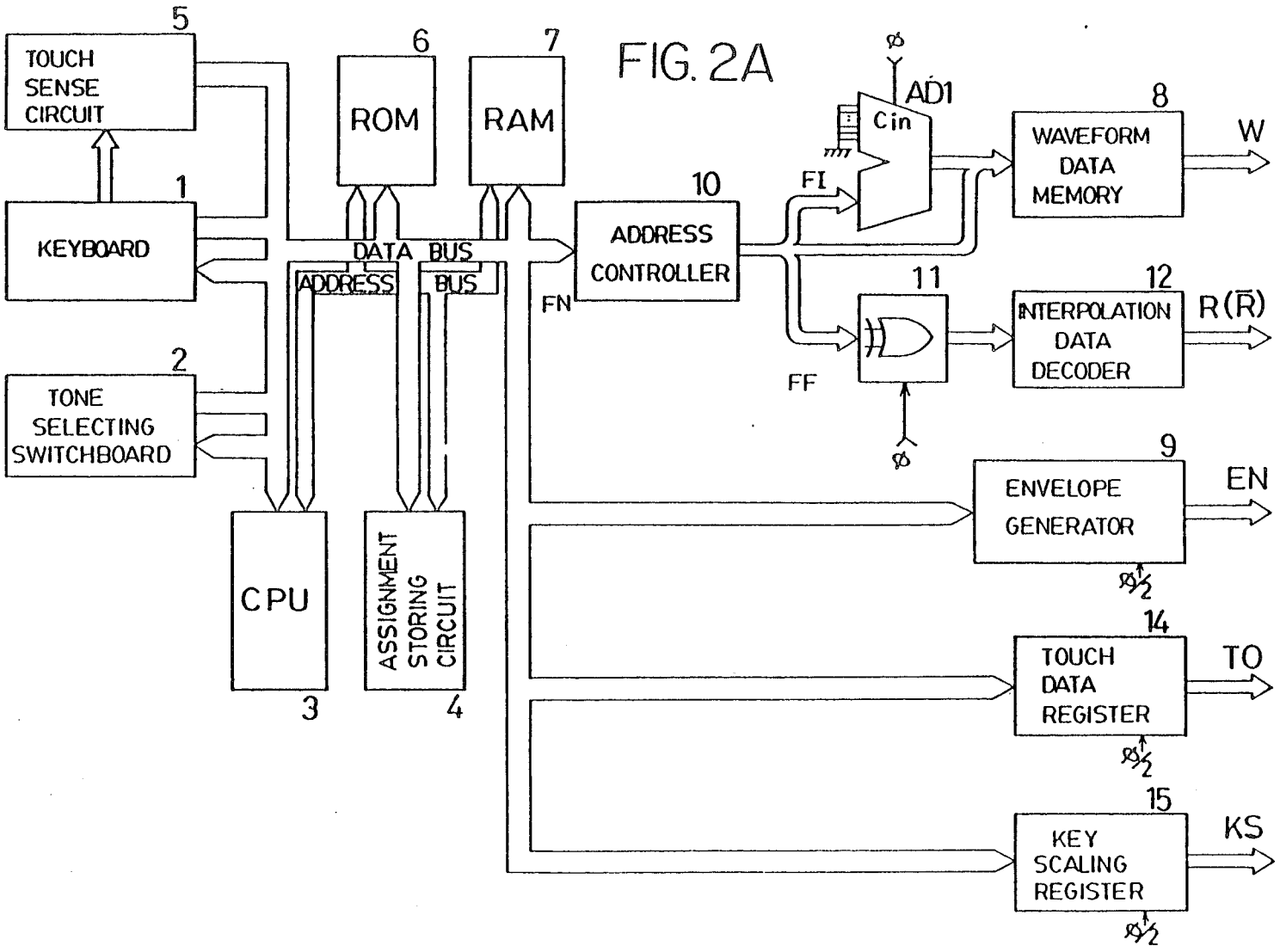
FIG. 2A and 2B are schematic circuit diagrams showing the whole construction of the system of the present invention.
Figure 2B:
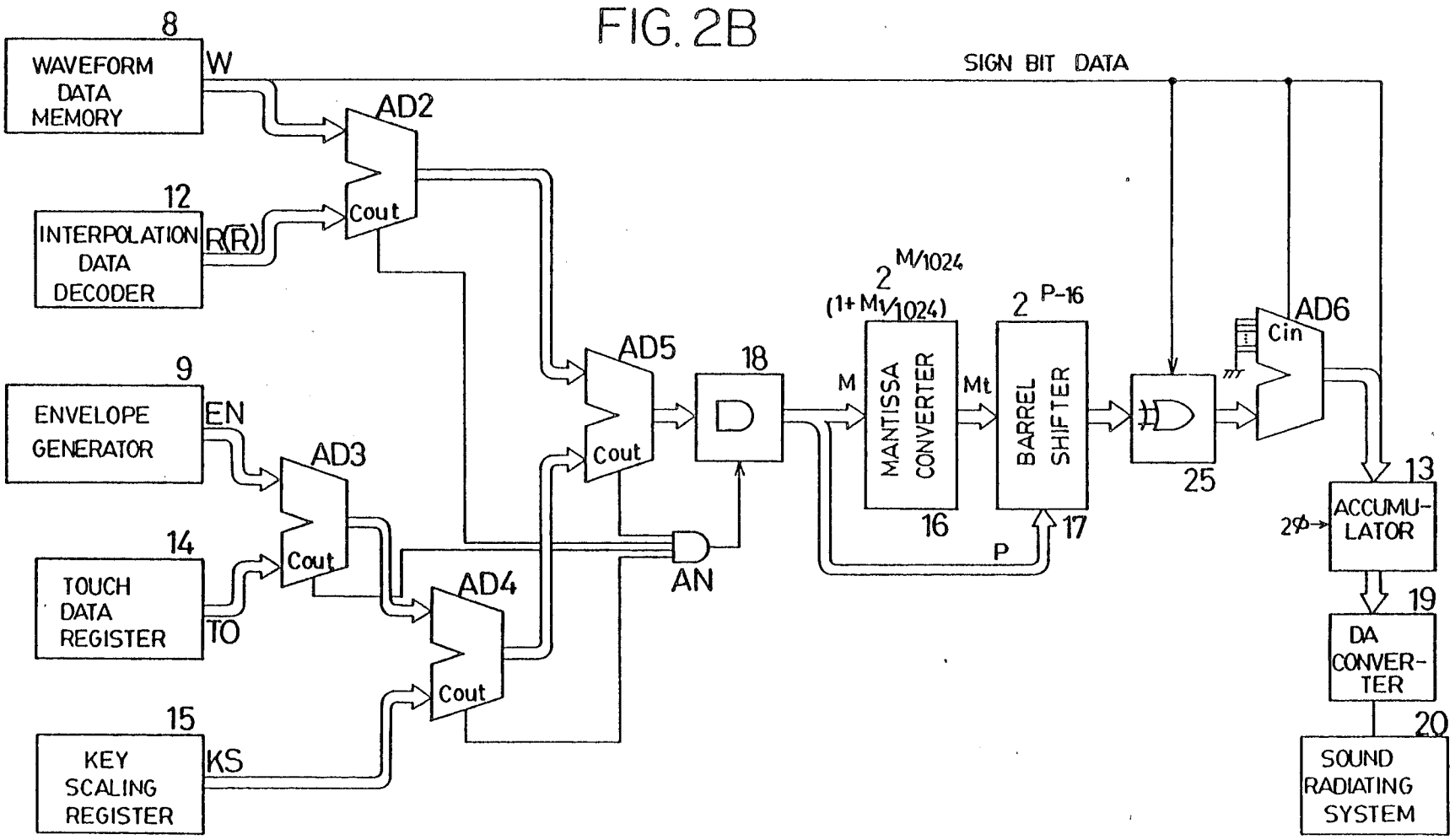

As seen from FIG. 2A, data obtained by adding all of the data W, R, $\overline{R}$, EN, TO and KS is output to the mantissa converter 16 and the barrel shifter 17 through a group 18 of AND gates, to each of which output signals of an AND gate AN are supplied as enable or disable signals. Further, all of the carry signals output from $C_{out}$ terminals of the adders are fed to each AND gate of the group 18. If no carry signals are output by the addition of the data W, R, $\overline{R}$, EN, TO and KS to each other, the AND gates of the group 18 are disabled and the result of the addition of the data W, R, $\overline{R}$, EN, TO and KS is made invalid.

In this embodiment, the power part data P, which is represented by high-order bits of data W, R, $\overline{R}$, EN, TO and KS indicating the result of the addition of the data, cannot become less than 16. This is because the downward shift of the data, which indicates the result of the addition, by the barrel shifter 17, as described later, is effected in such a manner that, as the power part data P varies from "1111" (=15) to "1110" (=14), and further . . . to "0000" (=0), the data indicating the result of the addition is correspondingly shifted to the right by 1 bit, 2 bits . . . , and finally, by 16 bits, and thus a downward shift of more than 16 bits cannot be performed.

This is explained in more detail with reference to FIG. 5. As shown in this figure, if both power part data P to be added to each other are "1111" (=15), the result of the addition of the power part data P is "11110" (=30). Therefore, excepting data "1" represented by a carry digit "1", i.e., the highest-order bit of the data indicating the result of the addition, the remaining part thereof is "1110" (=14). Namely, the power part data P of the remaining part becomes equal to 14. Therefore, the difference between the current value of the exponent (P-16) of the power data and a reference value 0 is equal to −2, and thus 2 bits are shifted by the downward shift; i.e., the quantity of the downward shift, defined herein as shifted bits, is 2 bits. Further, in another valid case where in the power part data P to be added are "1001" (=9) and "0111" (=7), the result of the addition of the power part data P is "10000" (=16). Therefore except for the "1" represented by the carry digit "1", the remaining part thereof is "0000" (=0), and thus the power part data P of the remaining part becomes equal to 0, and further, the difference between the current value of the exponent (P-16) and the reference value 0 is equal to −16. Accordingly, the quantity of the downward shift is 16 bits. Nevertheless, where the data P to be added is "1001" (=9) and "0101" (=5), the result of the addition of this data P is made "01110" (=14) by excepting the data "1" represented by the carry digit. Accordingly, the exponent (P-1) of the power data is equal to −2, and therefore, it is reasonable to conclude that the quantity of the down shift as defined above when adding the values "1001" (=9) and "0101" (=5) of the data P is equal to that of the downward shift where both of the data P to be added to each other are "1111" (=15). In practice, regardless of data represented by the carry digit, the result of the addition of the data P in the last or third case should be considered to be "11110" (=−2), and therefore, the correct quantity of the downward shift should be −18. Namely, it can be considered that the above-described discrepancy is due to the fact that this quantity of the downward shift exceeds the limit of the quantity of the downward shift by the barrel shifter 17.

If, however, the limit of the quantity of the downward shift by the barrel shifter 17 is larger than 16 bits, the range of the invalid data indicating the result of the addition (hereafter sometimes referred to as the result data), is changed. Namely, if the quantity of the downward shift by the barrel shifter 17 can be within 32 bits, the range of invalid result data is less than 32. Further, if the value indicated by sixth bit, i.e., the highest-order bit of the result data is "1", the result data is valid. Furthermore, if the quantity of the downward shift by the barrel shifter 17 can be within 24 bits, the range of invalid result data is less than 24. Further, if the value indicated by a fifth bit, i.e., the highest-order bit and that indicated by a fourth bit of the result data are equal to "1", the result data is valid. In this case, carry signals output from the adders corresponding to the fourth bit and the fifth bit are supplied through the AND gate AN to each AND gate of the group 18, as enable signals.

Note, a group of AND gates corresponding to the group 18 of the AND gates provided at the adder AD5 may be provided at each of the adders AD2, AD3 and AD4. Moreover carry signals output by each of the adders AD2, AD3 and AD4 may be input to the AND gates of the corresponding group as enable signals.

In the result data obtained by adding all of the data W, R, $\overline{R}$, EN, TO and KS output from the adder AD5, the mantissa part data M only is sent to the mantissa converter 16, whereupon the data M is converted to data Mt (hereafter referred to as mantissa power data) indicating a power of the mantissa in the form $(1+M_1/1024)$ instead of the mantissa data in the form of $(2^{M/1024})$. The data P, however, is sent to the barrel shifter 17, and the downward shift of the mantissa power data Mt is then effected.

The conversion of the data M to the data Mt is performed in the barrel shifter 17 in accordance with the following equations.

$$2^{M/1024} = 1 + M_1/1024 = Mt/1024 \quad (8)$$

Where the mantissa part data M is "110011001" (=819) as shown in FIG. 1.

$$M_1 = (2^{819/1024} - 1) \times 1024 = 759. \quad (9)$$

Namely, the converted mantissa data $M_1$ is "1011110111" (=759). The mantissa power data Mt is then obtained by adding data "1" represented by one bit to the converted mantissa data $M_1$, as an additional bit having an order higher the highest order of the bits used for representing the converted mantissa data $M_1$, and thus 11-bit data Mt having a value of "1101111011" (=1024+759)is output from the mantissa converter 16.

To obtain the value of the power data, it is necessary to divide the value of the mantissa power data Mt by 1024, i.e., to effect the downward shift of the mantissa power data Mt by 10 bits. In practice, however, the downward shift of the data Mt need not effected and the data Mt can be treated by assuming that a decimal point is positioned between the highest-order digit thereof and the next digit thereof.

Figure 6:
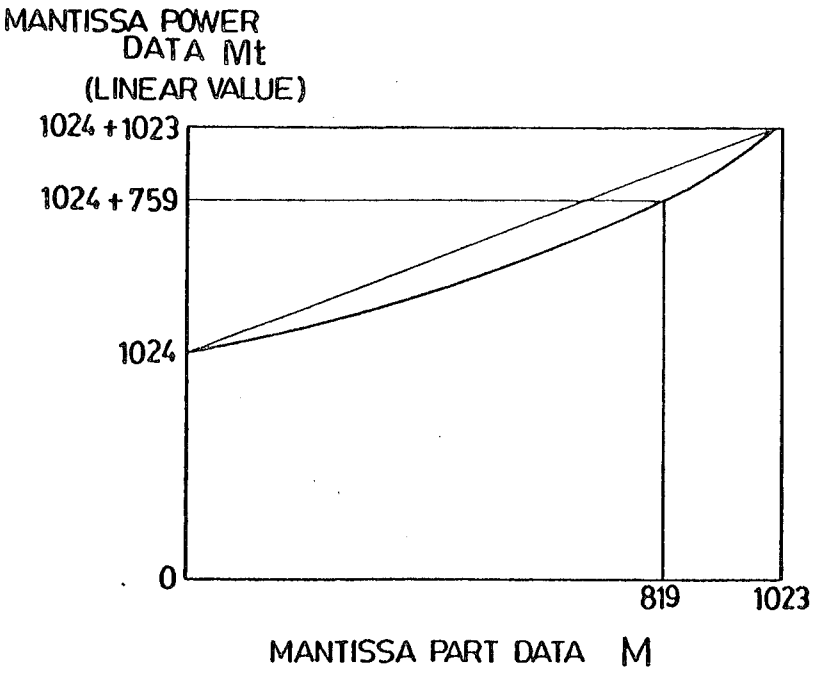
FIG. 6 is a graph illustrating the contents of a mantissa conversion table, as described later, used in a mantissa converter 16; and, FIG. 7 is a schematic circuit diagram illustrating the construction of a barrel shifter 17.
Figure 3:
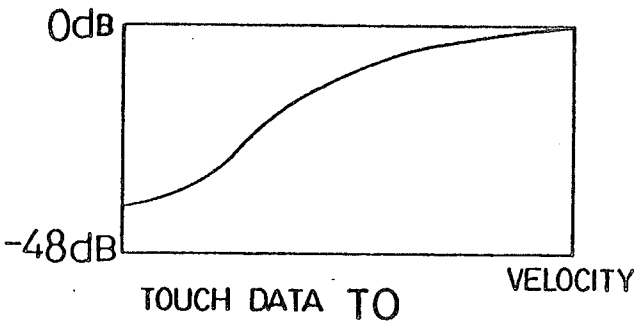
Figure 3:
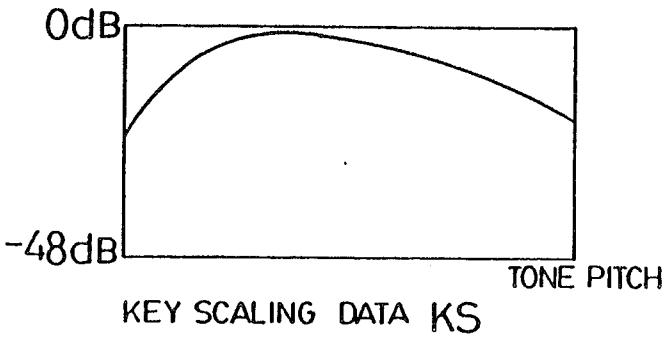

Note, the reason for converting the data M not to $2^{M/1024}$ but to the data Mt in the form of $(1+M_1/1024)$ is given as follows. First, the data using the mantissa part data M as a power of 2 has an exponential power as indicated by a bold solid curve in FIG. 6. Conversely, the data in the form of $(1+M_1/1024)$ has a linear power as indicated by a fine solid line in FIG. 6, and thus can be suitably regulated in accordance with a digital-to-analog (DA) converter 19 and a sound radiating system 20 including an amplifier and a loudspeaker. Further, the data M may be directly converted into data in the form of $2^{M/1024}$.

Figure 7:
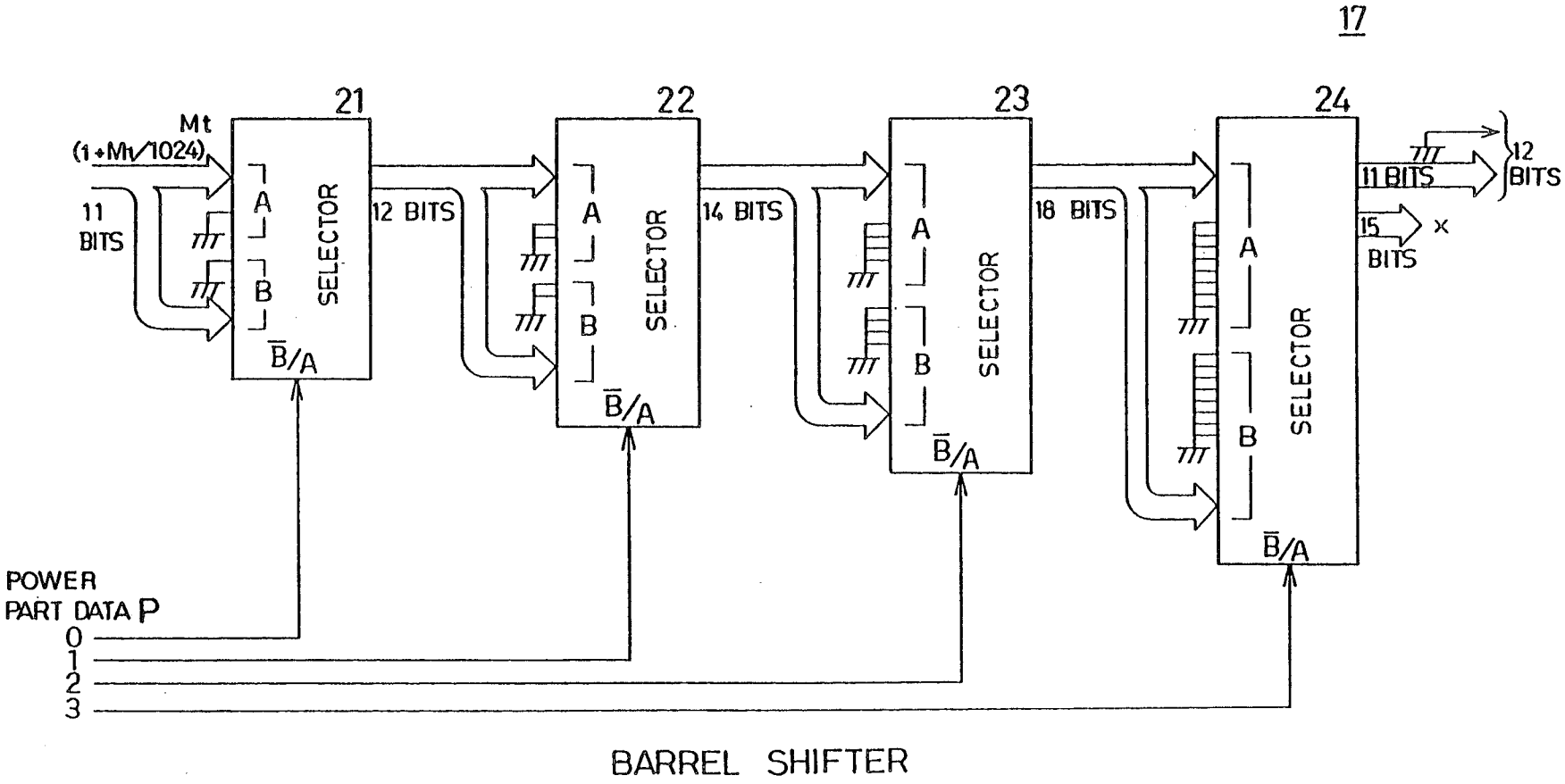

Next, the mantissa power data Mt is sent from the mantissa converter 16 to the barrel shifter 17, whereupon the downward shift of the data Mt is effected in accordance with the power part data P. FIG. 7 is a schematic block diagram showing the practical construction of the barrel shifter 17. The bit length of data to be input to input portions A and B of a selector 21 is 12 bits; that of data to e input to input portions A and B of a selector 22 is 14 bits; that of data to be input to input portions A and B of a selector 23 is 18 bits; and that of data to be input to input portions A and B of a selector 24 is 26 bits. Further, data "0" (corresponding to a lower level of the binary logical levels) represented by one bit is added to data represented by only higher-order 11 bits of 26-bit data output from the selector 24 as the value indicated by the highest-order bit of the thus-obtained 12-bit data, which is further sent to the EXOR gates 25. By adding "0" to the output data at the highest-order bit of the resultant data, the downward shift of the data thus finally output from the selector 24 is forcibly effected by 1 bit, and accordingly, a two's complement of the finally output data is obtained at the same time. Moreover, data "0" is input to the lowest-order bit of data to be input to the input portion A of the selector 21, the highest-order bit of data to be input to the input portion B of the selector 21, the low-order 2 bits (i.e., the rightmost 2 bits) of data to be input to the input portion A of the selector 22, the high-order 2 bits (i.e., the leftmost 2 bits) of data to be input to the input portion B of the selector 22, the low-order 4 bits i.e., the rightmost 4 bits) of data to be input to the input portion A of the selector 23, the high-order 4 bits (i.e., the leftmost 4 bits) of data to be input to the input portion B of the selector 23, the low-order 8 bits (i.e., the rightmost 8 bits of data to be input to the input portion A of the selector 24, and the high-order 8 bits (i.e., the leftmost 8 bits) of data to be input to the input portion B of the selector 24.

When data "0" is input to a selecting terminal B/A of the selector 21, the portion B is selected and then the mantissa power data Mt is output from the selector 21 after being shifted to the right by 1 bit. In contrast, when the data "1" (corresponding to a higher one of the binary logical levels) is input to the selecting terminal B/A of the selector 21, the terminal A is selected, and further, the mantissa power data Mt is output therefrom without being shifted. Further, when data "0" is input to a selecting terminal B/A of the selector 22, the input portion B of the selector 22 is selected and then the data Mt is shifted to the right by 2 bits, and further, is output from the selector 22. In contrast, when the data "1" is input to the selecting terminal B/A of the selector 22, the terminal A is selected, and further, the mantissa power data Mt is output therefrom without being shifted. Moreover, when data "0" is input to a selecting terminal B/A of the selector 23, the input portion B of the selector 23 is selected and then the date Mt is shifted to the right by 4 bits, and further, is output from the selector 23. In contrast, when the data "1" is input to the selecting terminal B/A of the selector 23, the terminal A thereof is selected, and further, the mantissa power data Mt is output therefrom without being shifted. Furthermore, when data "0" is input to a selecting terminal B/A of the selector 24, the input portion B of the selector 24 is selected and then the data Mt is shifted to the right by 8 bits, and further, is output from the selector 24. In contrast, when the data "1" is input to the selecting terminal B/A of the selector 24, the terminal A thereof is selected, and further, the mantissa power data Mt is output therefrom without being shifted.

At the selecting terminal B/A of each of the selectors 21, 22, 23 and 24, data represented by each bit of the power part data P is supplied, and the mantissa power data Mt is shifted to the right in accordance with the data P. Therefore, as shown in FIG. 4, the downward shift of the data Mt is effected in accordance with the data $2^{P-16}$, so that the value indicated by the data Mt is reduced in accordance with the data P.

In this case, the exponent (P-16) of the first operand ranges from $-1$ to $-16$, and therefore, the power data $2^{P-16}$ ranges between $2^{-1}$ and $2^{-16}$. On the other hand, the mantissa data M ranges from 0 to 1023, so that the mantissa power data Mt $(=1+M_1/1024)$ ranges from around $2^0 (=1)$ to $2^1 (=2)$. Consequently, the resultant musical tone data obtained by synthesizing both the data P and M, i.e., the data $2^{P-16}\times(1+M_1/1024)$, ranges from $2^{-1}\times 2^1$ (=1 (corresponding to 0 dB)) to $2^{-16}\times 2^0$ ($=2^{-16}$ ($-96$ dB)$\div 0$ (corresponding to $-\infty$)).

Namely the increase in number of bits of the musical tone data is suppressed or controlled by this downward shift of the data.

The musical tone data is output from the barrel shifter 17 through the group 25 of the EXOR gates and an adder AD6, to the accumulator 13. A sign bit data represented by the highest-order bit of the data FI of the accumulated frequency number data is applied to each EXOR gate of the group 25, and the sign of the tone data is determined in accordance with the sign bit data. Further, data "00 . . . 00" is input to the adder AD6 at a terminal thereof other than ac $C_{in}$ terminal and the terminal to which the musical tone data is input, and the sign bit data is input thereto at the Cin terminal. The musical tone data is incremented by +1 only when inverted in the group 25 of the EXOR gates, and as a result, the musical tone data is inverted in the group 25 of the EXOR gates and the adder AD6 to a two's complement thereof only where the sign bit date indicates "1".

Thereafter, this musical tone data passes through the group 25 of the EXOR gates and the adder AD6, the musical tone data of all of the channels is accumulated and synthesized in the accumulator 13, and the resultant data is output through the DA converter 19 and the sound radiating system 20. The period of accumulating by this accumulator 13 is one-half the period of the clock signal $\phi$. Further, the interpolating and adding processing of the waveform data $W_n$ and $W_{n+1}$, which are weighted in accordance with the interpolation data R and $\overline{R}$, is effected.

Although a preferred embodiment of the present invention has been described above, it is understood that the present invention is not limited thereto and that other modifications will be apparent to those skilled in the art without departing from the spirit of the invention.

For example, the data W, R, $\overline{R}$, EN, TO and KS, which is data represented by powers of two in the foregoing embodiment, may be represented by powers of $2^{\frac{1}{2}}, 2^{\frac{1}{4}}, \ldots, 2^2$ or $2^4$. Alternatively, the data W, R, $\overline{R}$, EN, TO and KS may be data represented by powers of an integer (or a number) other than two. Further, the number 16 in the exponent (P-16) of the power data may be another number less than 16. Additionally, the operational expression ($2^{P-1} \times 2^{M/1024}$) indicating the relation ship between the power and mantissa data may be replaced by another operational expression, for example, an addition and subtraction expression ((aM+b)+(cP-d)) (Note, $cP \leqq d$), a multiplication and division expression ((aM+b)×(cP/d)) Note, ($cP \leqq d$), a logarithmic expression ($\log_d(bM+c)+\log_d(eP/f)$) (Note, $eP \leqq f$), and a trigonometric expression (( sin (aM+b)× cos (cP/d)) (Note, $cP \leqq d$). Furthermore, in musical tone data, the power part data may be represented by bits having orders which are lower than bits used for representing the mantissa part data M, and thus a carry from the data M into the data P can be generated. Note, the operational expression used for the musical tone information or data can be applied to information on the weights or mixing levels of musical tones varied with time, information on amplitude levels of musical tones, modulation factor information, information on changes in tone pitch, information on proportions of higher harmonic components, and so forth.

The scope of the present invention, therefore, is to be determined solely by the appended claims.

I claim:

1. In an electronic musical instrument, a method of performing an operational expression representing an operation on power data and mantissa data for computing problem data, used in generating a musical tone, said method comprising the steps of:

depressing one of a plurality of keys of a keyboard to generate problem data;

representing said problem data, which is used to generate the musical tone, by using a system for representing musical tone data by which said musical tone data includes said power data and said mantissa data which have the same sing, and by which a value of one of said power data and said mantissa data represented by bits having a higher order, is reduced by performing a suppressing operation including a suppressing parameter having a value larger than the value of one of said power data and said mantissa data represented by bits having the higher order and the value of which is to be reduced;

computing mantissa data of the represented problem data which is used to generate the musical tone in accordance with power data of the represented problem data; and performing a carry operation if a carry is generated in said mantissa data to produce an audio output signal with maximum dynamic range by a sound radiating system.

2. The method of claim 1, wherein the suppressing operation is one of subtraction and division.

3. The method of claim 1, wherein the suppressing operation is one of addition and multiplication.

4. The method of claim 1, wherein said power data and said mantissa data are two to an m-th power (m is a real number or an integer).

5. The method of claim 1, wherein said power data and said mantissa data are n to an m-th power (m is a real number or an integer number and n is a real number or an integer other than two and zero).

6. The method of claim 1 wherein the operation on said power data and said mantissa data is expressed by one of a power operation expression, an addition expression, a subtraction expression, a multiplication expression, a division expression, a logarithmic expression and a trigonometric expression.

7. The method of claim 4 wherein, after performing an addition of the exponents of said power and mantissa data, the addition is made valid only when a carry signal is generated in the exponent of one of the power data and mantissa data represented by bits having a higher order.

8. The method of claim 4 wherein, when performing the addition of the exponents of the power and mantissa data, if a different number of bits is required to represent the exponents, with respect to the one of the power and mantissa data, represented by bits having a higher order than those bits used to represent the other one of the power and mantissa data, a number equal to the difference between the exponent of the power data and the exponent of the mantissa data is added to the exponent of the one of the power and mantissa data as additional data represented bits of the orders higher than the highest-order bit of the exponent represented by bits of the least number, and with respect to the other of said operands, a number equal to the difference between the exponent of the power data and the exponent of the mantissa data is added to the exponent of the other one of the power and mantissa data as additional data represented bits of the orders lower than the highest-order bit of the exponent represented by bits of the least number, wherein the number of bits representing the exponents of the power and mantissa data are made equal to each other.

9. The method of claim 1, wherein the problem data includes waveform data.

10. The method of claim 1, wherein the problem data includes envelope data.

11. The method of claim 1, wherein the problem data includes timbre data.

12. The method of claim 1, wherein the problem data includes touch data.

13. The method of claim 1, wherein the problem data includes key scaling data.

14. The method of claim 1, wherein the problem data includes interpolation data.

15. The method of claim 1, wherein the problem data includes information on amplitude levels of musical tones.

16. The method of claim 1, wherein the problem data includes information on weights of musical tones.

17. The method of claim 1, wherein the problem data includes information on mixing levels of musical tones varied with time.

18. The method of claim 1, wherein the problem data includes modulation factor information.

19. The method of claim 1, wherein the problem data includes information on changes in tone pitch.

20. The method of claim 1, wherein the problem data includes information on proportions of higher harmonic components.

21. In an electronic musical instrument in which musical tone information is represented by using power data and mantissa data with a floating-point representation, a musical tone information representation system, comprising:

keyboard means for responding to depression of one of a plurality of keys by an operator by generating the power data and mantissa data;

generation means for generating an exponent of the mantissa data and an exponent of the power data having the same sign as the exponent of the mantissa data which is used to generate a musical tone;

operation means for obtaining data whose order is higher than an order of an exponent of said mantissa data by shifting an exponent of the power data and for performing one of an addition and a subtraction operation on the exponent of the mantissa data and the obtained data; and conversion means for inverting the sign of the exponent of the power data by performing an operation on both of the exponent of the power data and the exponent other than the exponents of the power and mantissa data and for converting the power data and the mantissa data into data with a fixed point representation to produce an audio output signal with maximum dynamic range through a sound radiating system.

22. The musical tone information representation system of claim 21, wherein said power data and said mantissa data are n to an m-th power (m is a real number or an integer number and n is a real number or an integer other than two and zero).

23. The musical tone information representation system of claim 21, wherein, after performing an addition of the exponents of said power and mantissa data, the addition is made valid only when a carry signal is generated in the exponent of one of the power data and mantissa data represented by bits having a higher order.

24. The musical tone information representation system of claim 21 wherein if a number of bits required for representing the exponent of the power data is larger than a number of bits required for representing the exponent of the mantissa data, said operation means adds bits each representing "1" of a number equal to the difference between exponent of the power data and the exponent of the mantissa data to the exponent of the mantissa data as data represented by bits of an order higher than a highest-order bit of the exponent of the mantissa data, and wherein if the number of bits required for representing the exponent of the power data is smaller than the number of bits required for representing the exponent of the mantissa data, the operation means adds bits representing "1" or bits each representing "0" of the number equal to the difference between the exponent of the power data and the exponent of the mantissa data to the exponent of the power data as data represented by bits of an order lower than a highest-order bit of the exponent of the power data.

25. The musical tone information representation system of claim 21, wherein the musical tone information includes waveform data.

26. The musical tone information representation system of claim 21, wherein the musical tone information includes envelope data.

27. The musical tone information representation system of claim 21, wherein the musical tone information includes timbre data.

28. The musical tone information representation system of claim 21, wherein the musical tone information includes touch data.

29. The musical tone information representation system of claim 21, wherein the musical tone information includes key scaling data.

30. The musical tone information representation system of claim 21, wherein the musical tone information includes interpolation data.

31. The musical tone information representation system of claim 21, wherein the musical tone information includes information on amplitude levels of musical tones.

32. The musical tone information representation system of claim 21, wherein the musical tone information includes information on weights of musical tones.

33. The musical tone information representation system of claim 21, wherein the musical tone information includes information on mixing levels of musical tones varied with time.

34. The musical tone information representation system of claim 21, wherein the musical tone information includes modulation factor information.

35. The musical tone information representation system of claim 21, wherein the musical tone information includes information on changes in tone pitch.

36. The musical tone information representation system of claim 21, wherein the musical tone information includes information on proportions of higher harmonic components.

37. An electronic musical instrument comprising:

keyboard means for providing a plurality of keys, each of which generate an input signal, which may be depressed by an operator in order to select a musical tone;

touch sensing means for sensing an elapsed time from when one of said plurality of keys was depressed and generating a touch signal from the elapsed time;

waveform data memory means for storing a plurality of waveform data for musical tones;

envelope generating means for generating a plurality of envelope data;

read-only memory means for storing a plurality of timbre coefficient data;

central processing means for receiving the input signal from said keyboard and converting the input signal into a frequency number, for retrieving one of the plurality of timbre coefficient data from said read-only memory means and using the timbre efficient data for selecting one of the plurality of waveforms of musical tones stored in said waveform data memory means and one of the plurality of envelopes stored in said envelope generating means;

assignment storing means for assigning the selected musical tone to one of a plurality of idle channels;

key scaling means for converting the input signal from said keyboard into a key scale signal;

address controlling means for receiving frequency number data for a predetermined channel time and separating the frequency number data into fraction data and integer data;

first exclusive-ORing means for performing an exclusive-OR operation on said fraction data to produce exclusive-ORed fraction data;

first adding means for accumulating integer data to produce waveform data for the selected musical tone;

interpolation data decoding means for receiving and interpolating said exclusive-ORed fraction data to produce interpolated waveform data for the selected musical tone;

key scaling storing means for storing said key scale signal;

second adding means for adding the waveform data for the selected musical tone and said interpolated waveform data for the selected musical tone to produce a second output signal;

third adding means for adding one of said plurality of envelope data and said touch signal to produce a third output signal;

fourth adding means for adding said third output signal and said key scaling signal to produce a fourth output signal;

fifth adding means for adding said second output signal and said fourth output signal to produce a fifth output signal, which includes a mantissa part (M) and a power part (P);

mantissa converting means for receiving the mantissa part (M) of said fifth output signal and converting the mantissa part to a converted mantissa part ($M_1$) according to the equation:

$$2^{M/1024} = 1 + M_1/1024$$

and for incrementing the converted mantissa part ($M_1$) by "1" to produce mantissa power data ($M_t$);

barrel shifting means for receiving the mantissa power data ($M_t$) and the power part to produce an operand by performing a shift operation on the mantissa power data according to a value of the power part including, first selecting means for shifting the mantissa power data to the right by one bit if a least significant bit of the power part is a "1", second selecting means for shifting the mantissa power data to the right by two bits if a second least significant bit of the power part is a "1", third selecting means for shifting the mantissa power data to the right by three bits if a third least significant bit of the power part is a "1", and fourth selecting means for shifting the mantissa power data to the right by four bits if a most significant bit of the power part is a "1";

second exclusive-ORing means for performing an exclusive-OR operation on a plurality of bits of said operand and a sign bit of the selected musical tone to produce an exclusive-OR output;

sixth adding means for adding the exclusive-OR output and the sign bit of the selected musical tone to produce a sixth output signal;

accumulating means for accumulating the sixth output signal;

digital-to-analog converting means for converting the accumulating sixth output signal to an analog signal; and sound radiating means for receiving the analog signal and producing an audio output signal.

38. An electronic musical instrument comprising:

means for generating waveform data, interpolated waveform data, envelope data, touch data, and key scaling data from a depressed key;

first adding means for adding the waveform data and said interpolated waveform data to produce a first operand;

second adding means for adding the envelope data and the touch signal to produce a first intermediate signal;

third adding means for adding said first intermediate signal and said key scaling signal to produce a second operand;

fourth adding means for adding said first operand and said second operand to produce an output signal, which includes a mantissa part (M) and a power part (P);

mantissa converting means for receiving the mantissa part (M) of said fourth output signal and converting the mantissa part to a converted mantissa part ($M_1$) according to the equation:

$$2^{M/1024} = 1 + M_1/1024$$

and for incrementing the converted mantissa part ($M_1$) by "1" to produce mantissa power data ($M_t$);

barrel shifting means for receiving the mantissa power data ($M_t$) and the power part to produce an operand by performing a shift operation on the mantissa power data according to a value of the power part including, first selecting means for shifting the mantissa power data to the right by one bit if a least significant bit of the power part is a "1", second selecting means for shifting the mantissa power data to the right by two bits if a second least significant bit of the power part is a "1", third selecting means for shifting the mantissa power data to the right by three bits if a third least significant bit of the power part is a "1", and fourth selecting means for shifting the mantissa power data to the right by four bits if a most significant bit of the power part is a "1";

exclusive-ORing means for performing an exclusive-OR operation on a plurality of bits of said operand and a sign bit of the waveform data to produce an exclusive-OR output;

fifth adding means for adding the exclusive-OR output and the sign bit of the waveform data to produce a fifth output signal;

sound generating means for accumulating the fifth output signal, converting the accumulated fifth output signal to an analog signal, and producing an audio output signal, wherein the mantissa part and power part have the same sign, and wherein the one of the mantissa part and power part with a higher order is reduced by performing a suppression operation using a suppression parameter which has a value greater than both the mantissa and power parts.

* * * * *